United States Patent [19]

Hamm et al.

[11] 4,067,190

[45] Jan. 10, 1978

[54] CATALYTIC GAS TURBINE COMBUSTOR WITH A FUEL-AIR PREMIX CHAMBER

[75] Inventors: James R. Hamm, Franklin Borough; Prith P. Singh, Monroeville, both of Pa.

[73] Assignee: Westinghouse Electric Corporation, Pittsburgh, Pa.

[21] Appl. No.: 749,594

[22] Filed: Dec. 10, 1976

Related U.S. Application Data

[63] Continuation of Ser. No. 617,616, Sept. 29, 1975, abandoned.

[51] Int. Cl.[2] ..... F02C 7/22

[52] U.S. Cl. ..... 60/39.69 A; 60/39.71; 431/170; 431/346

[58] Field of Search ..... 60/39.65, 39.71, 39.74 R, 60/39.82 C, 39.69 A; 431/7, 170, 346

[56] References Cited

U.S. PATENT DOCUMENTS

| | | | |
|---|---|---|---|
| 3,081,818 | 3/1963 | Braconier et al. | 431/346 |
| 3,155,142 | 11/1964 | Stack | 431/346 |
| 3,859,786 | 1/1975 | Azelborn et al. | 60/39.65 |
| 3,928,961 | 12/1975 | Pfefferle | 60/39.71 |
| 3,938,326 | 2/1976 | De Corso | 60/39.69 A |

OTHER PUBLICATIONS

Wade et al., "Low Emissions Combustion for Regenerative Gas Turbine", pp. 38, 39; Journal of Eng. for Power, Jan, 1974.

*Primary Examiner*—Robert E. Garrett
*Attorney, Agent, or Firm*—F. A. Winans

[57] ABSTRACT

A combustor for a gas turbine is shown having a catalytic reactor element to promote low temperature combustion of the fuel. An air-fuel premix chamber is provided in the upstream end of the combustor arrangement to produce a mixture which is substantially uniform throughout a plane transverse to the direction of flow of the mixture just prior to the catalytic element. The premix chamber comprises a short cylindrical member of less diameter than the shell of the combustor and closed at the upstream end, with the opposite end discharging directly to the catalytic element. The upstream portion of the walls of the cylinder contain apertures so that the air and fuel introduced into the upstream end of the combustor must flow axially into the annular space between the shell and the chamber, then the flow is abruptly changed to a somewhat radial component to enter the apertures and then the flow is again abruptly changed to an axial direction to enter the catalytic reactor. This provides a sufficiently tortuous path to uniformly mix the air-fuel components prior to entering the catalytic elements.

1 Claim, 1 Drawing Figure

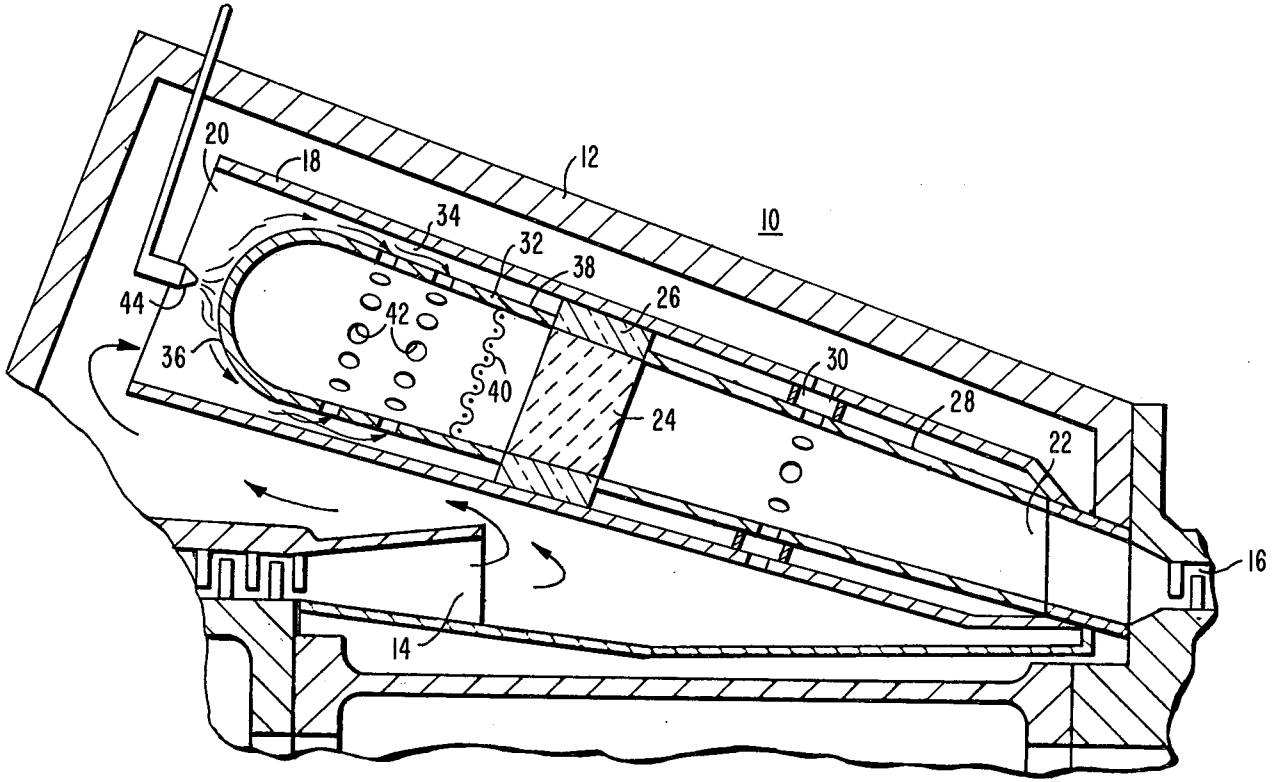
16
22
28
30
10
26
24
12
38
32
40
34
42
18
20
36
44
14

CATALYTIC GAS TURBINE COMBUSTOR WITH A FUEL-AIR PREMIX CHAMBER

This is a continuation of application Ser. No. 617,616 filed Sept. 29, 1975, now abandoned.

BACKGROUND OF THE INVENTION

1. Field of the Invention

The invention relates to gas turbine combustors and more particularly to a combustor having a catalytic reactor element and a premix chamber for uniform mixture of the air and fuel components prior to entering the catalytic element.

2. Description of the Prior Art

In gas turbine combustors utilizing catalytic reactor elements it is relatively important to maintain the air-fuel mixture entering the catalytic element generally uniform throughout a plane transverse to the direction of flow just prior to the element. Otherwise, with poor mixture, extra lean or extra rich mixtures may enter portions of the catalytic element, where, because of confined internal passages, they are prevented from further mixing and thus the improper mixture ratios can produce smoke, CO, $NO_x$, unburned hydrocarobons or even result in temperatures that can destroy the catalyst. Thus, it can be seen, without proper premixing, the catalytic element can in fact result in the formation of an undesirable exhaust which it was primarily intended to eliminate.

To avoid this, the air-fuel mixture is caused to premix to a uniform predetermined ratio within which the catalytic element was designed to operate and, in fact, reduces such types of undesirable exhaust components. Such uniform premixing can be accomplished by having a sufficiently long flow path subsequent to the commingling of the air and the fuel to give the two an opportunity to become thoroughly mixed. However, because of the limitations on size and bulk of a commercially feasible gas turbine, the combustion chambers must be kept within acceptable size limitations. Other considerations require the mixing to be done with a relatively low pressure loss to maintain the overall efficiency of the turbine.

Swirling apparatus have been used, however, such devices still permit some stratification of the airfuel mixture such that the mixture is not uniform across the catalyst.

SUMMARY OF THE INVENTION

The present invention provides a premix chamber within the combustor shell and upstream of the catalyst, through which all air-fuel must flow prior to the catalyst, establishing a tortuous path in which the air-fuel mixture becomes generally uniform. The premix chamber is in the form of a cylinder having a closed contoured upstream end and openings in the cylindrical side wall. The fuel is injected into the high pressure air in the upstream portion of the shell and the commingled air-fuel then follows a flow path having an axial component through the annular space between the shell and the cylinder, abruptly changing to a radial component to enter the cylinder through the openings in the side wall, and again abruptly changing to an axial component to flow to the catalyst in a generally uniform mixture across a plane transverse to the direction of flow.

In addition to the uniform mixture reducing the development of hot spots in the catalytic reactor along with generally eliminating the production of $NO_x$, CO, etc., it also produces a relatively uniform or flat exit temperature profile of the exhaust gases that, if necessary, can be easily mixed with diluent air to provide the desired temperature profile for entering the nozzle area.

BRIEF DESCRIPTION OF THE DRAWING

FIG. 1 is a cross-sectional elevational schematic drawing of a combustor arrangement of the present invention.

DESCRIPTION OF THE PREFERRED EMBODIMENT

Referring to FIG. 1, a combustor can 10 of a gas turbine engine is shown. As is known, a plurality of such combustor cans generally encircle the engine between the compressor discharge 14 and the power turbine inlet 16 so as to receive high pressure air from the compressor and discharge the motive fluid subsequent to combustion into the power turbine.

The combustor cans 10 are housed in a portion of the outer casing 12 of the turbine with each comprising a generally tubular combustor shell 18 having an upstream end 20 admitting high pressure air thereinto and a downstream discharge portion 22 for directing combustion discharge gases to the power turbine.

A catalytic reactor element 24 is disposed within the shell 18 at a position generally intermediate of the inlet and discharge ends. The element 24 is generally well known in the art and defines, in a honeycomb type of array, a plurality of individual passages extending axially therethrough with the walls of each passage coated with a catalytic material to promote combustion of air-fuel mixtures passing therethrough. The honeycomb element 24 is supported in an annular collar member 26 preferably of a ceramic material so as to withstand the high temperatures generated within the element.

Downstream of the catalytic element 24 is a generally cylindrical duct 28 for directing the hot discharge gases from the element to the discharge end 22. An air manifold 30 may encircle the duct 28 to provide an inlet for diluent air if desired to obtain the preferred temperature profile in these hot gases.

An air-fuel premix chamber 32 is disposed immediately upstream of the catalytic element 22 and comprises a generally cylindrical chamber of smaller diameter than the shell 18 to define an annular space 34 therebetween and terminates in a rounded or contoured closed end 36 adjacent the inlet portion 20 of the shell 18. The downstream end 38 of the chamber 32 is in a generally close association and concentric with the collar member 26 enclosing the catalytic element to provide a closed air-fuel path through the chamber 32 to the element 24.

The upstream portion of the cylindrical wall 33 of the premix chamber 32 defines a plurality of rather large apertures 42 through which the air-fuel mixture flows from the annular space 34 to enter the chamber.

A fuel nozzle 44 configured to eject either liquid or gaseous fuel into the shell is disposed in the upstream portion of the shell 18 and forces fuel into the air flow stream somewhat ahead of the closed end 36 of the premix chamber. A flame arrester screen 40 is dispsosed within the premix chamber a short distance upstream of the catalytic element to prevent the combustion within the catalytic element from entering the premix chamber during those periods when there is insufficient velocity in the mixture to otherwise keep the flame within the element.

Thus, with this arrangement, fuel is injected into the upstream portion of the air path in the shell 18. The non-homogenous air-fuel mixture is then confined to an annular space 34 forcing all air into relatively close proximity to the entrained fuel. Thence the air flow path is abruptly changed from a generally axial direction to a direction having a radial component when entering the premix chamber 32 through the apertures 42 and again the flow path is abruptly changed to an axial direction immediately after entering the premix chamber. These abrupt directional changes provide a tortuous path inducing sufficient mixing action between the air and fuel to obtain a generally homogenous distribution of the fuel throughout a plane transverse to the direction of flow just upstream of the catalytic element 24.

The homogenous air-fuel mixture entering the catalytic reactor, although subsequently being prevented from further mixing within the catalytic element, provides relatively uniform combustion temperatures and other desirable combustion conditions (i.e., limited emission of undesirable exhaust products, etc.) throughout any transverse plane in the catalytic element. Thereby, with proper regulation of inlet fuel quantities, the generation of undesirable emissions and unburned gases can be controlled.

It is to be noted that with this arrangement, the total overall length of the premix chamber in addition to the distance the fuel inlet nozzle is upstream of the premix chamber is relatively short and compact so that such uniform or homogenous mixture can be attained in a relatively short distance compatible with present acceptable combustor dimensions.

We claim:

1. A combustor arrangement for a gas turbine including:

a combustor shell having an upstream portion in fluid flow communication with high pressure incoming air and a discharge end for discharging the products of combustion;

means for delivering fuel to said shell adjacent the upstream portion;

a catalytic reactor element disposed within said shell intermediate said upstream portion and in a confined fluid flow path to said discharge end; and, means within said shell for generally uniformly mixing the air and fuel delivered to said catalytic member, said mixing means comprising:

a tubular member defined by a cylindrical wall having a major axis generally parallel to the air flow through said shell and spaced from the wall of said shell to form an annular space therebetween;

an end wall closing the upstream end of said cylindrical wall, the opposite end of said cylindrical wall defining a confined fluid flow path for discharging directly into said catalytic element for combustion therein;

flame arrester means within said tubular member generally intermediate of said upstream end and said catalytic element to prevent combustion moving from said catalytic element to said upstream end; and a plurality of apertures in the cylindrical wall of said tubular member generally adjacent the upstream end thereof whereby air and fuel entering the upstream end of said shell must initially flow axially into said annular space then radially to enter said tubular member through said apertures and again axially to flow through said catalytic element whereby said air and fuel must flow in a tortuous flow path including the upstream end of said clindrical wall producing thorough mixing of the air-fuel prior to entering said catalytic element.

* * * * *